US007290414B2

(12) United States Patent
Houser et al.

(10) Patent No.: US 7,290,414 B2
(45) Date of Patent: Nov. 6, 2007

(54) INTEGRATED LAUNDRY SUSPENSION SYSTEM

(75) Inventors: Marvin Joseph Houser, South Elgin, IL (US); Robert Stuart Feldmann, Londonderry, NH (US); Joseph A. Knopp, Batavia, IL (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 644 days.

(21) Appl. No.: 10/811,339

(22) Filed: Mar. 26, 2004

(65) Prior Publication Data

US 2005/0210603 A1 Sep. 29, 2005

(51) Int. Cl.
*D06F 29/00* (2006.01)

(52) U.S. Cl. ..... 68/23.3; 68/23.1

(58) Field of Classification Search ..... 68/23.1–23.3; 8/158

See application file for complete search history.

(56) References Cited

U.S. PATENT DOCUMENTS

| | | | | | |
|---|---|---|---|---|---|
| 2,969,172 | A * | 1/1961 | Hutt | 68/23.3 |
| 3,108,465 | A * | 10/1963 | Bochan | 68/23.1 |
| 3,197,983 | A * | 8/1965 | Ilmer | 68/23.1 |
| 3,277,742 | A * | 10/1966 | Jacobsen | 68/23.1 |
| 3,285,419 | A * | 11/1966 | Smith | 210/144 |
| 3,475,928 | A * | 11/1969 | Wasemann | 68/23.2 |
| 3,952,557 | A * | 4/1976 | Bochan | 68/23.3 |
| 4,250,724 | A * | 2/1981 | Altnau | 68/23.2 |
| 4,468,938 | A * | 9/1984 | McMillan | 68/23.3 |
| 4,475,363 | A * | 10/1984 | Thomson | 68/23.3 |
| 4,502,303 | A * | 3/1985 | Wasemann | 68/23.2 |
| 5,377,508 | A | 1/1995 | Hair et al. | |
| 5,946,947 | A * | 9/1999 | Lee et al. | 68/23.3 |
| 5,950,460 | A | 9/1999 | Oh | |
| 6,220,063 | B1 | 4/2001 | Wunderlich et al. | |
| 6,574,997 | B1 * | 6/2003 | Mayer et al. | 68/23.1 |

FOREIGN PATENT DOCUMENTS

| | | |
|---|---|---|
| DE | 4413069 A1 * | 10/1994 |
| WO | WO 0068488 A1 * | 11/2000 |

* cited by examiner

*Primary Examiner*—Joseph L. Perrin
(74) *Attorney, Agent, or Firm*—Harness, Dickey & Pierce, P.L.C.

(57) ABSTRACT

A suspension system for use in a laundry washing machine to suspend a tub assembly from a base portion of a cabinet. The suspension system includes a support frame interconnected to an outer tub of the tub assembly and an isolation damper assembly for resiliently coupling the support frame to the base portion of the cabinet. The isolation damper assembly functions to allow limited lateral movement of the tub assembly relative to the cabinet while also providing a "return to center" feature. The isolation damper assembly is further operable to prevent rotation of the outer tub relative to the cabinet. Finally, the isolation damper assembly functions to absorb the vibration transmitted through the tub assembly to the support frame so as to minimize transmission of such vibration to the cabinet.

21 Claims, 13 Drawing Sheets

INTEGRATED LAUNDRY SUSPENSION SYSTEM

BACKGROUND OF THE INVENTION

1. Field of the Invention

The present invention relates generally to laundry washing machines and, more particularly, to a top-loading washing machine having an integrated suspension system.

2. Description of the Prior Art

Laundry washing machines of the top-loading variety typically include a cabinet having a base, a four-sided housing secured to the base, and a top enclosure secured to the top of the housing which has a lid to provide access to a spin basket. The spin basket is rotatably mounted within an outer tub and is perforated to allow the wash water to be transferred into the outer tub during the centrifugal extraction or "spin" cycle. Such washing machines also include a drive assembly for controlling high-speed rotation of the spin basket as well as low-speed oscillatory movement of an agitator which is centrally located within the spin basket. Typically, the drive assembly includes an electric motor and a transmission that are mounted to a support structure. In turn, the support structure is mounted between the outer tub and the base of the cabinet by a suspension system that is adapted to absorb excessive vibration from unbalanced loads that may occur, for example, during the high speed spin cycle.

One example of a conventional suspension system for top-loading washing machines uses a dome-type pivot assembly between the support structure and the cabinet base that is anchored by a plurality of centering springs. The dome-type assembly typically includes a raised male dome segment centrally formed in the base and a corresponding female dome segment associated with the support structure. A low friction member, such as a plastic snubber ring, is disposed between the aligned dome segments. The centering springs provide several functions including connecting the support structure and outer tub to the base, preventing rotation of the outer tub during the spin cycle, and allowing limited lateral movement of the outer tub while providing a means for automatically returning the outer tub to a centered position relative to the cabinet.

One particular concern with top-loading washing machines is the need to prevent excessive lateral movement of the outer tub caused by unbalanced loads of clothes in the spin basket during the spin cycle. Depending upon the amount and location of the load, it is possible to generate resonant frequencies that are capable of causing the outer tub to strike the sidewalls of the cabinet. In addition, the suspension system must also be able to accommodate rotation of the spin basket without transmitting the resultant vibration to the floor so as to prevent "walking" of the washing machine. In an attempt to address these concerns, many top-loading washing machines having the conventional spring-type suspension system are also equipped with a counterweighted ring at the top of the spin basket and/or an unbalance sensor that is operable for automatically de-energizing the drive assembly upon occurrence of an excessive out-of-balance condition.

In view of the above, there is a recognized need in the field of laundry washing machines to design and develop improved suspension systems that address the shortcomings of conventional spring-type systems which can be commercially produced at an economical cost.

SUMMARY OF THE INVENTION

Accordingly, it is an objective of the present invention to provide an integrated suspension system for laundry washing machines which is an improvement over conventional spring-type suspension systems.

A further objective is to provide a washing machine equipped with an integrated suspension system having an isolation damper assembly resiliently coupling the outer tub and drive assembly components to a base portion of the cabinet.

An additional objective is to utilize the isolation damper assembly in top-loading washing machines to improve the vibration isolation and damping characteristics of the suspension system.

In accordance with these and other objectives, the present invention is directed to a suspension system for use in a laundry washing machine to suspend a tub assembly from a base portion of a cabinet. The suspension system includes a support frame interconnected to an outer tub of the tub assembly and an isolation damper assembly for resiliently coupling the support frame to the base portion of the cabinet. The isolation damper assembly functions to allow limited lateral movement of the tub assembly relative to the cabinet while also providing a "return to center" feature. The isolation damper assembly is further operable to inhibit rotation of the outer tub relative to the cabinet. Finally, the isolation damper assembly functions to absorb the vibration transmitted through the tub assembly to the support frame so as to minimize transmission of such vibration through the cabinet to the floor. The improved vibration absorption provided by the isolation damper assembly also results in a reduction in the operational noise levels generated by the washing machine.

In a preferred arrangement, the isolation damper assembly of the present invention includes a first case member adapted for connection to the base of the cabinet, a second case member spaced from and connected to the first case member, a resilient isolator member disposed between the first and second case members, and a mounting member adapted to connect the isolator member to the support frame. To accommodate limited lateral movement between the tub assembly and the cabinet, the resilient isolator member has a slip fit engagement with the mounting member. Furthermore, the resilient isolator member has an aperture adapted to engage a hub segment on one of the first and second case members for limiting excessive lateral movement of the tub assembly and automatically returning the tub assembly to its centered position.

In a further preferred arrangement, the isolator member of the isolation damper assembly is fabricated from a microcellular polyurethane material and has a central aperture with a plurality of lobes imparting a compressive preload on the cylindrical hub segment of the case member. In accordance with another preferred arrangement, the cylindrical hub segment may include a projection adapted to be disposed between a pair of adjacent lobes so as to provide an anti-rotation arrangement between the case member and the resilient isolator member. In accordance with yet another preferred arrangement, the hub segment on the case member is configured to define a plurality of radially extending projections which engage the wall surface of a circular aperture formed in the resilient isolator member. In each configuration, a plurality of distinct areas of contact are defined between the aperture of the resilient isolator member and the hub segment of the case member.

BRIEF DESCRIPTION OF THE DRAWINGS

The above objectives and various preferred arrangements, as well as additional advantageous features of the present invention, will become apparent from the following description and the appended claims in view of the accompanying drawings wherein:

DETAILED DESCRIPTION OF THE PREFERRED EMBODIMENT

In general, the present invention is directed to an improved suspension system for use in laundry washing machines that provides significant operational and cost advantages over conventional spring-type suspension systems. To better understand these advantages, a conventional washing machine will initially be described with reference to FIG. 1 of the drawings so as to clearly define the current state of the art.

Figure 1:
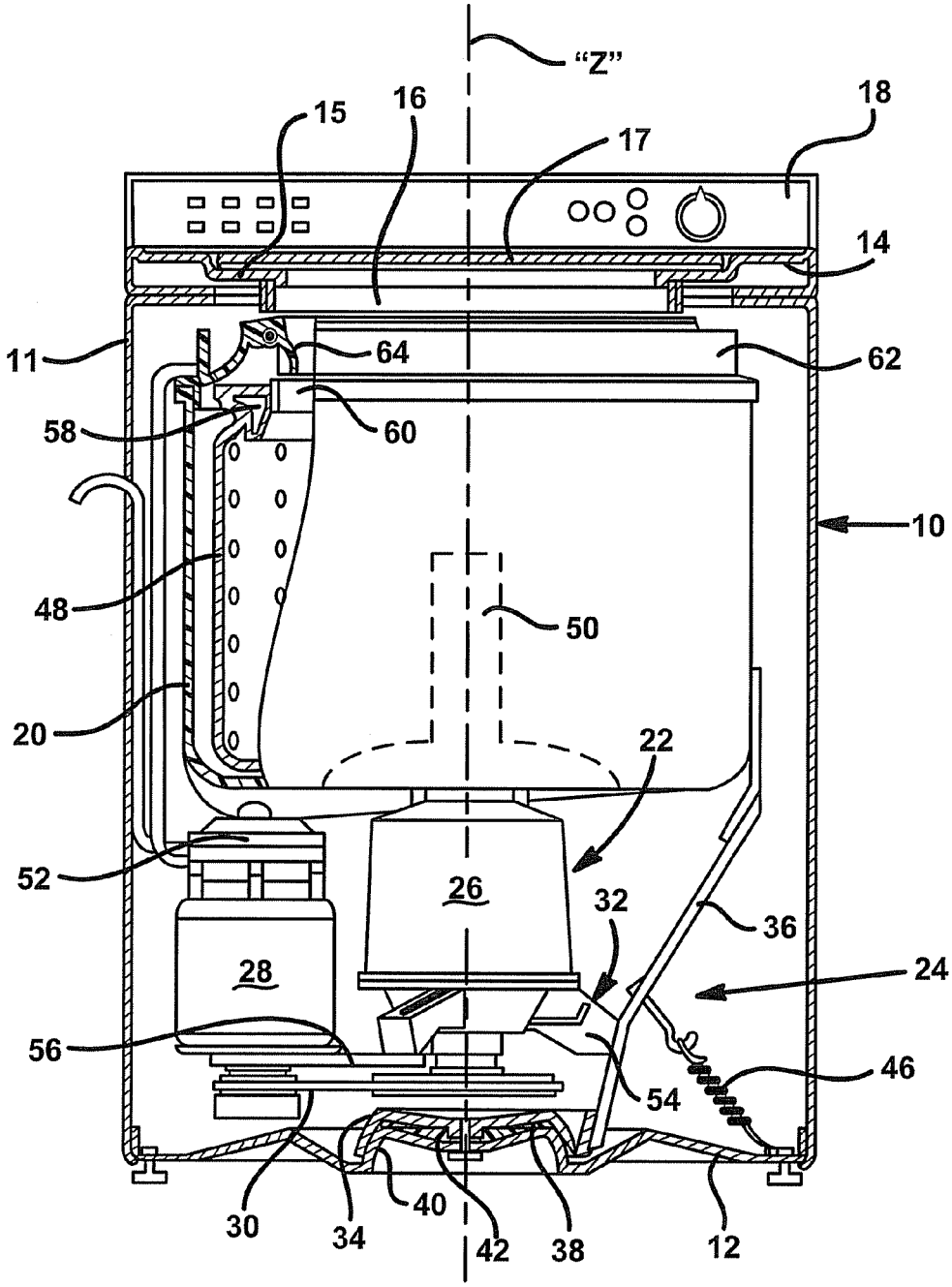
FIG - 1 Prior Art
FIG. 1 is an elevational view of a top-loading laundry washing machine, partially in section, showing a tub assembly mounted to a cabinet base via a conventional spring-type suspension system.
Figure 2:
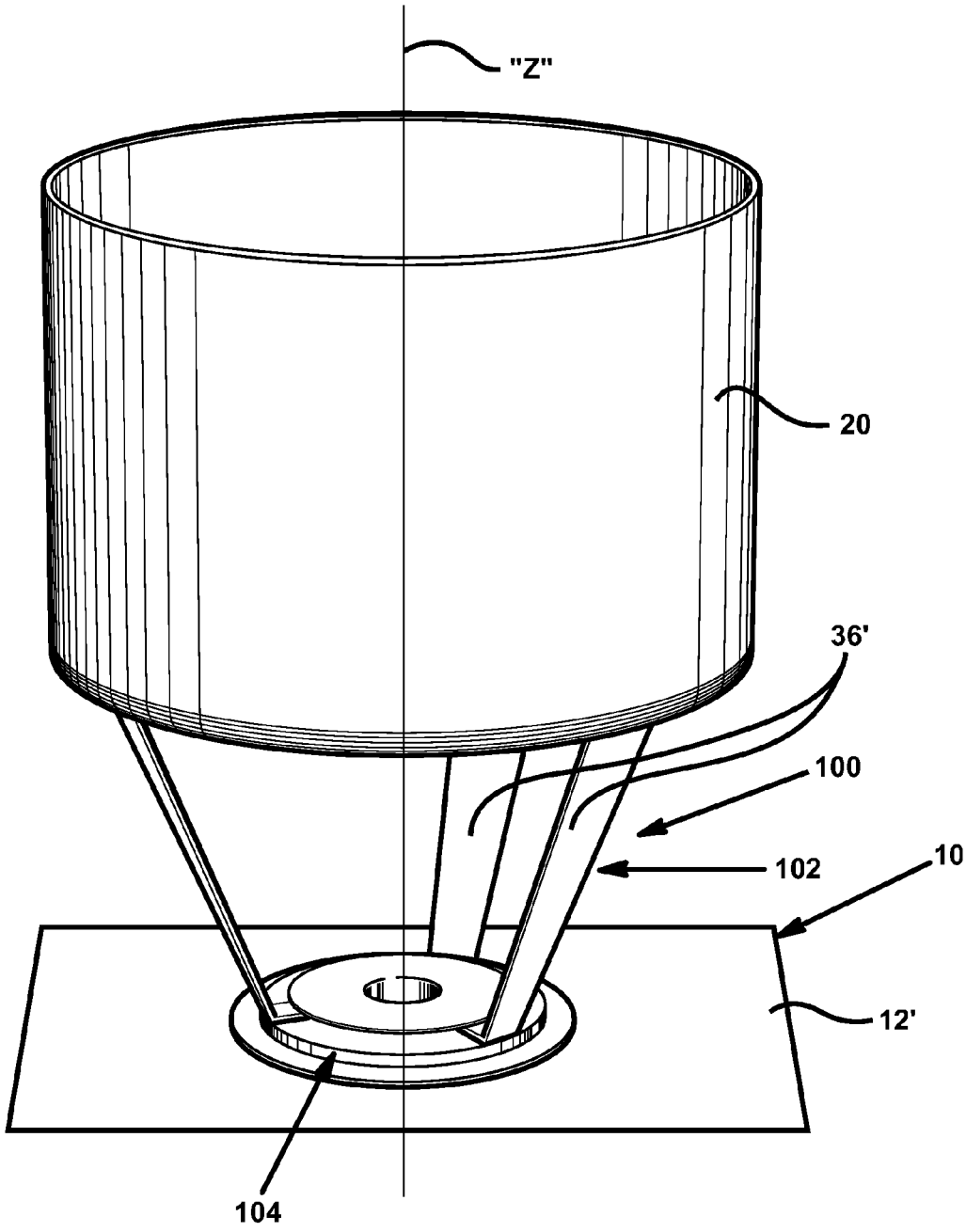
FIG. 2 is a perspective view of an integrated suspension system interconnecting the tub assembly to the cabinet base in a laundry washing machine according to the present invention.
Figure 3:
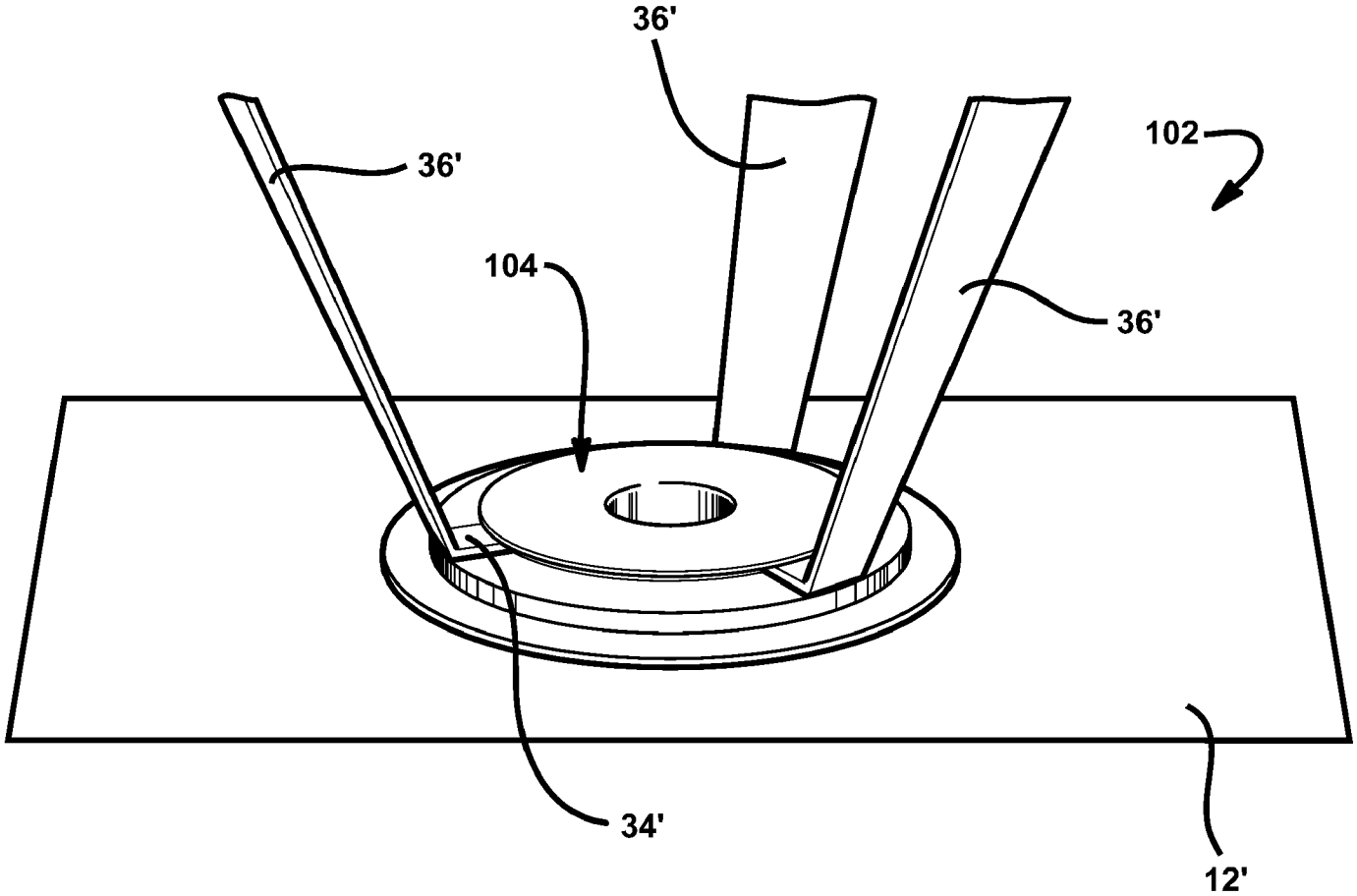
FIG. 3 is an enlarged portion of FIG. 2 showing an isolation damper assembly, associated with the integrated suspension system of the present invention, operably installed between the cabinet base and an outer tub mounting structure.
Figure 4:
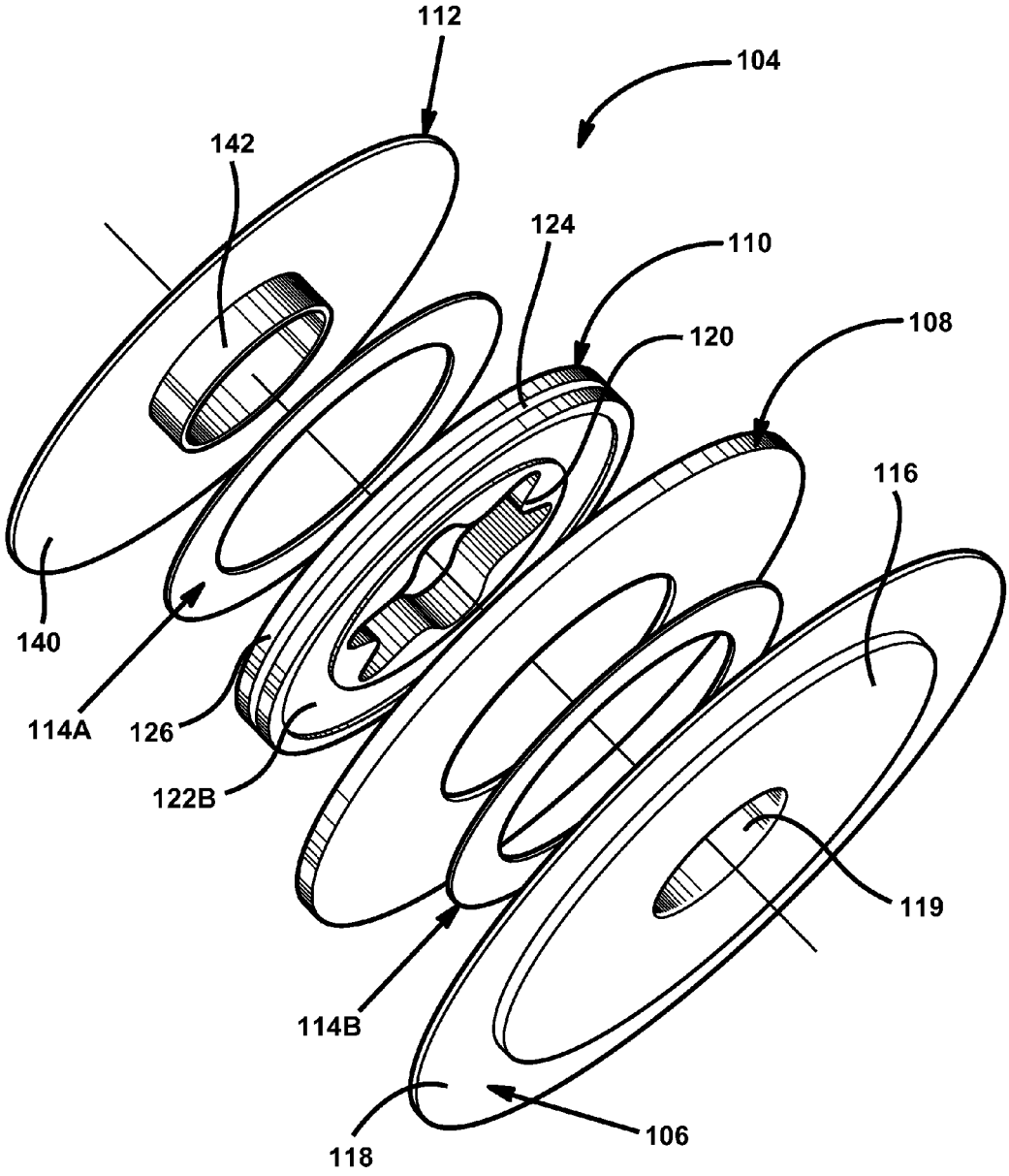
FIGS. 4 and 5 are exploded perspective views of the isolation damper assembly in accordance with a preferred embodiment of the present invention.
Figure 5:
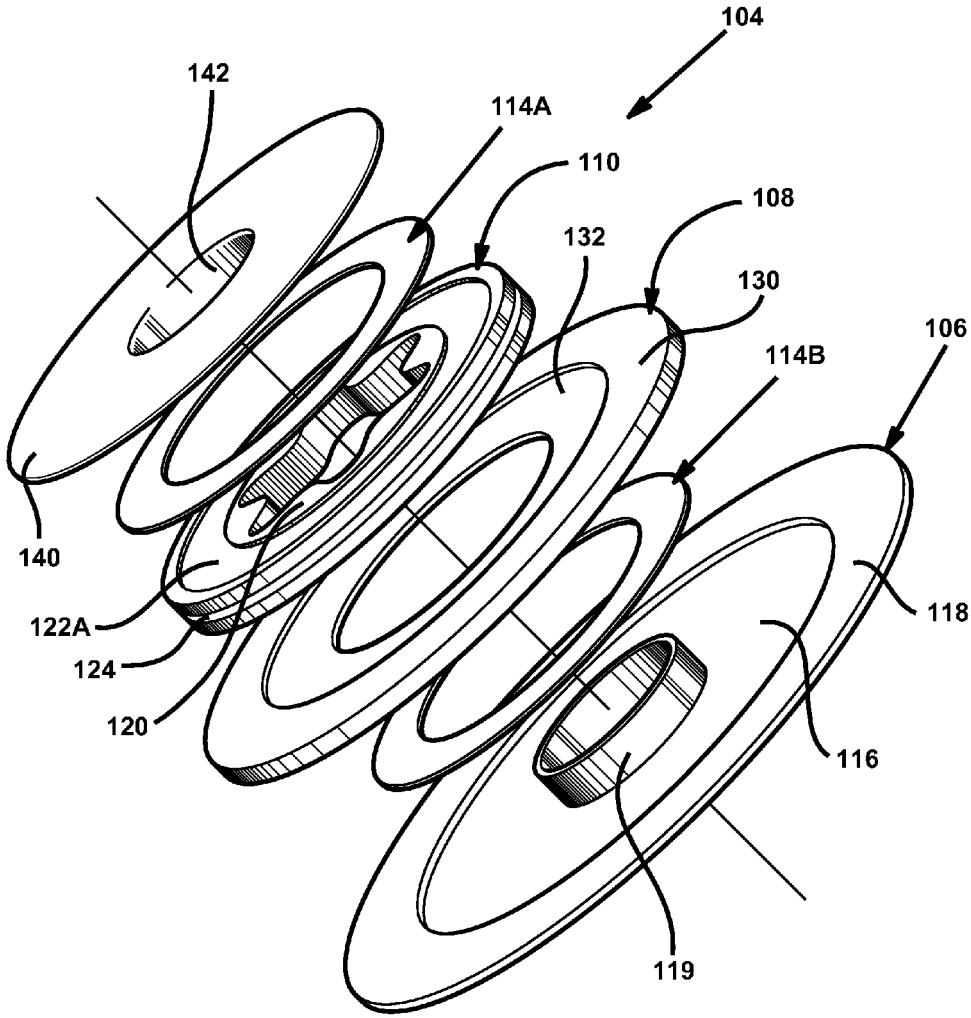

As shown in FIG. 1, a typical top-loading washing machine includes a cabinet 10 having a housing with four sidewalls 11 which extend upwardly from a base 12. A top enclosure 14 is shown to be mounted to cabinet 10 on top of sidewalls 11. Top enclosure 14 has a central recessed portion 15 which defines an access opening 16 that is covered by a hinged lid 17. A control panel 18 is mounted to top enclosure 14 and includes a plurality of control members (i.e., dials, knobs, push buttons, etc.) for permitting selection of the desired washing cycles and water temperatures in a well-known manner.

Within cabinet 10, the washing machine mechanism is shown to include a tub assembly having an outer tub 20 and a drive assembly 22 that are resiliently mounted to base 12 via a suspension system 24. Drive assembly 22 includes a transmission 26 that is centrally located below outer tub 20 and an electric motor 28 for driving transmission 26 via a drive belt 30. Suspension system 24 includes a support frame 32 having a ring member 34 and a plurality of braces 36. Braces 36 are equally spaced and have a first end rigidly secured to outer tub 20 and a second end rigidly secured to ring member 34. As seen, ring member 34 defines a recessed cup segment 38 which is aligned with a central dome 40 formed in base 12. A suitable low-friction centering member, commonly referred to as a snubber ring 42, is disposed in the annular space between cup segment 38 of ring member 34 and dome segment 40 of base 12. This ball socket type arrangement allows outer tub 20 to pivot about a vertical axis "Z" located at the center of dome segment 40 with snubber ring 42 acting to damp movement therebetween. Suspension system 24 further includes a plurality of centering springs 46 which each extend from brace 36 down to a position on the outermost edge of base 12. Centering springs 46 function to bias support frame 32 and outer tub 20 to a centered position aligned with the vertical axis while also inhibiting rotation of outer tub 20 relative to base 12. In many arrangements, at least six centering springs 46 are used to provide the requisite self-centering function.

The tub assembly of the washing machine mechanism is shown to further include a perforated spin basket 48 that is mounted inside outer tub 20 for rotation about the vertical axis and which is driven by motor 28 through transmission 26. Transmission 26 also drives an agitator 50 (shown in phantom) which extends upwardly within spin basket 48. A pump 52 is mounted on motor 28 and is operable to control the delivery and drainage of water to and from spin basket 48 during operation of the washing machine. As seen, transmission 26 is mounted to cross brackets 54 which, in turn, are connected to braces 36 such that transmission 26 is supported by support frame 32. Likewise, motor 28 is mounted to a support plate 56 that is also part of support frame 32. A weighted balance ring 58 is attached to the open upper end of spin basket 48 such that its central aperture 60 is aligned with access opening 16 of top enclosure 14. Finally, a tub cover 62 is attached to the open upper end of outer tub 20 and has a central aperture 64 which is also aligned with access opening 16 in top enclosure 14.

Operation of the washing machine is conventional in that it functions in either a wash mode or a spin mode. In the wash mode, transmission 26 is shifted into a first stage for oscillating agitator 50 at low speeds within spin basket 48 which is filled with clothes, water, and detergent. Upon completion of the wash cycle, transmission 26 is shifted into a second stage for rotating spin basket 48 at a high speed so as to establish the spin cycle. During the spin cycle, the clothes are thrown by centrifugal force against spin basket 48 and the water drains through the perforations into outer tub 20 and is subsequently pumped out of the washing machine.

The present invention is generally directed to an improved suspension system for laundry washing machines. In particular, the improved suspension system of the present invention is well-suited for use with top-loading washing machines having a construction generally similar to the washing machine shown in FIG. 1. As will be detailed, the improved suspension system of the present invention functions to eliminate the dome-type pivot arrangement and the centering springs while providing superior vibration isolation and damping characteristics.

To accomplish the objectives of the present invention, FIGS. 2 through 8 disclose an integrated suspension system 100 that is applicable for use in laundry washing machines. Integrated suspension system 100 is comprised of a support frame 102 interconnected to outer tub 20 and an isolation damper assembly 104 resiliently coupling support frame 102 to base 12' of cabinet 10. Support frame 102 is generally similar to support frame 32 shown in FIG. 1 in that it supports the entire tub assembly as well as the drive components. In particular, support frame 102 includes an annular ring 34' and a plurality of equidistantly-spaced braces 36' rigidly secured thereto. The upper end of each brace 36' is either directly secured to outer tub 20 or, in the alternative, secured to an upper plate or ring that is then secured to outer tub 20. It will be appreciated that the specific design and configuration of support frame 102 is not critical to the present invention, but rather it functions to interconnect outer tub 20 to isolation damper assembly 104 and support the various drive components. Thus, any frame or support arrangement which provides these functions will be considered an equivalent to the support structure shown.

According to the present invention, isolation damper assembly 104 provides several integrated functions including: allowing limited lateral movement of tub 20 relative to base 12'; providing a mechanism for returning tub 20 to a centered position within cabinet 10; and absorbing vibration transmitted through tub 20 and support frame 102 and/or the other components attached thereto. The integration of these functions into isolation damper assembly 104 results in a significant reduction in the overall cost of the suspension system by eliminating components and simplifying the assembly process and permits its use with only minor redesign of some of the components currently used in production laundry appliances.

In general, isolation damper assembly 104 is installed in substitution for snubber ring 42 and centering springs 46. As best seen from FIGS. 4 through 8, isolation damper assembly 104 includes a lower case member 106, a mounting ring 108, a resilient isolator 110, an upper case member 112 and a pair of glide rings 114A and 114B. Lower case member 106 is adapted to be secured to base 12' of cabinet 10. Base 12' is a modified version of conventional base 12 in that central domed segment 40 of base 12 has been eliminated and replaced with a circular recessed portion that is adapted to accept receipt of a circular cup segment 116 of lower case member 106. Location of cup segment 116 with the complimentary recessed portion of base 12' functions to centrally align isolation damper assembly 104 on the vertical "Z" axis of the washing machine mechanism. As an alternative, lower case member 106 can be planar with cup segment 116 eliminated for direct connection to a planar portion of base 12'. Lower case member 106 is also shown to include an outer rim segment 118 and an upstanding tubular hub segment 119. It is contemplated that outer rim segment 118 will be non-rotatably secured via suitable fasteners (i.e., bolts, clips, etc.) to base 12'. In accordance to a non-limiting preferred fastening arrangement, outer rim segment 118 will have tabs that can be inserted into corresponding slots in base 12' to define a releasable rotary-type quick connect fastening arrangement which facilitates easy installation and service.

With continued reference to the drawings, isolator 110 is shown to include a contoured central aperture defining a plurality of tooth-shaped projections or lobes 120, a first or upper annular channel 122A adapted to receive glide ring 114A, a second or lower annular channel 122B adapted to receive glide ring 114B, and a continuous peripheral groove 124 formed in its outer edge surface 126. When isolation damper assembly 104 is fully assembled, the terminal end of lobes 120 on isolator 110 engage an outer wall surface of tubular hub segment 119 of lower case member 106. Preferably, such engagement results in a compressive load being applied to lobes 120 so as to inhibit rotation of isolator 110 relative to lower case member 106. As an option, an anti-rotation feature can be provided by forming vertical channels in cylindrical hub segment 119 which are sized to seat the terminal end of each lobe 120 therein, thereby preventing rotation of isolator 110 relative to lower case member 106.

Preferably, isolator 110 has at least three equally-spaced lobes 120 with the specific number thereof selected based on the needs of the particular application. In addition, isolator 110 is preferably fabricated from a microcellular polyurethane (MCU) material. The MCU material is preferred since it provides several advantageous features including superior vibration isolation characteristics, mechanical durability, resistance to most environmental fluids (i.e., oil, grease, ozone, water, etc.) and its low mass. In addition, the MCU material has a wide operating temperature range and low compression set characteristics. Furthermore, the MCU material can be "tuned" by changing the material density within a common mold in order to obtain the optimal isolation properties for each specific application. However, it is to be understood that any suitable material providing the required compressibility and resiliency characteristic can be used for isolator 110 as required for each particular application. Examples of alternative materials include rubber, plastic, thermoplastics, etc. Finally, isolator 110 can be assembled from a plurality of isolator segments that are retained between case members 106 and 112.

Figure 6:
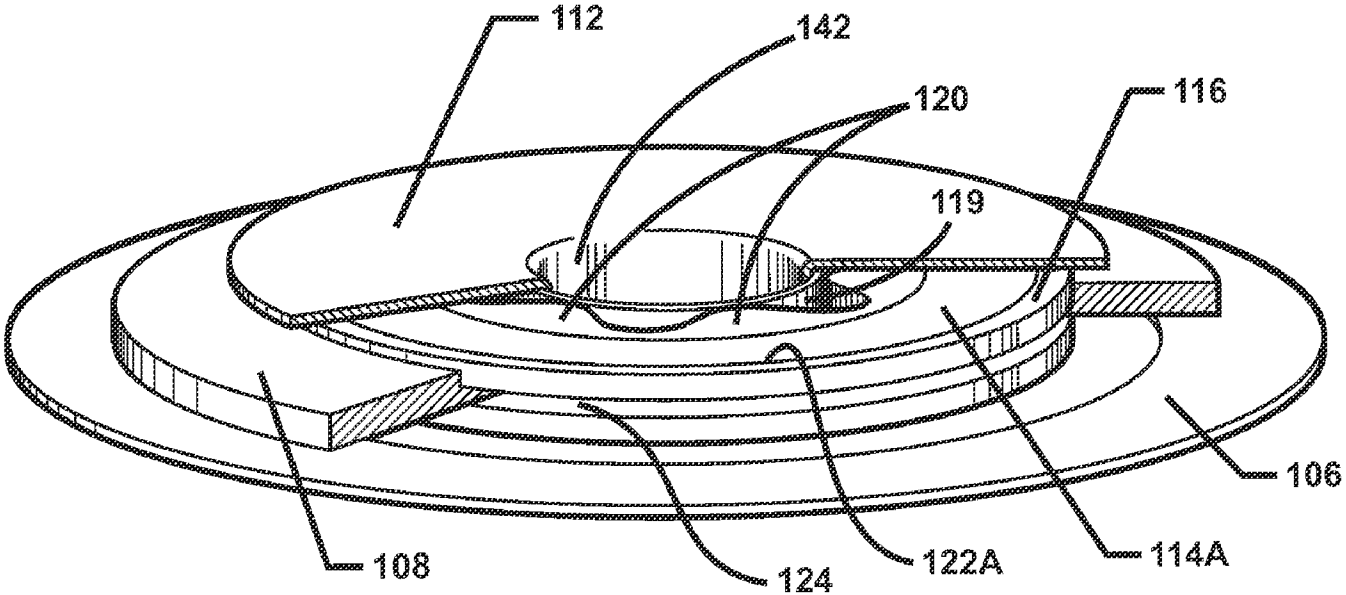
FIG. 6 is an assembled perspective view, with some components partially shown in section, of the isolation damper assembly shown in FIGS. 4 and 5.
Figure 7:
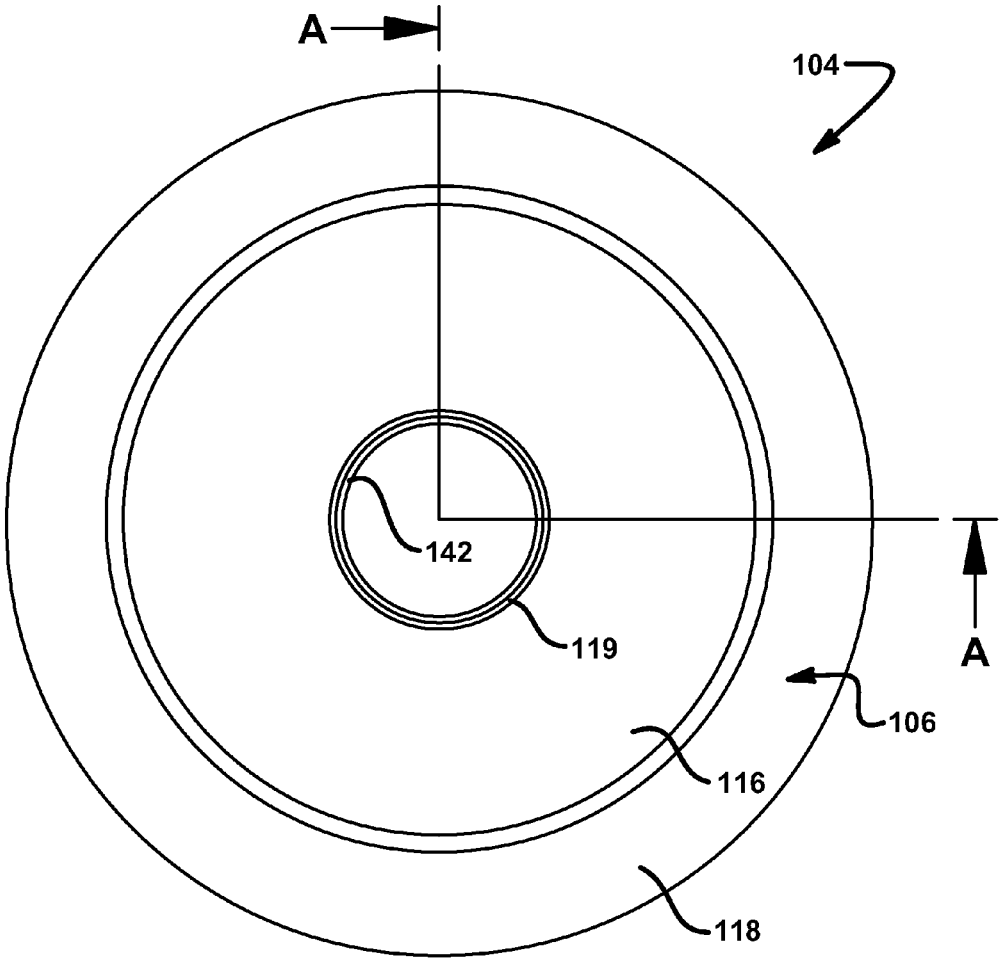
FIG. 7 is a top plan view of the isolation damper assembly.
Figure 8:
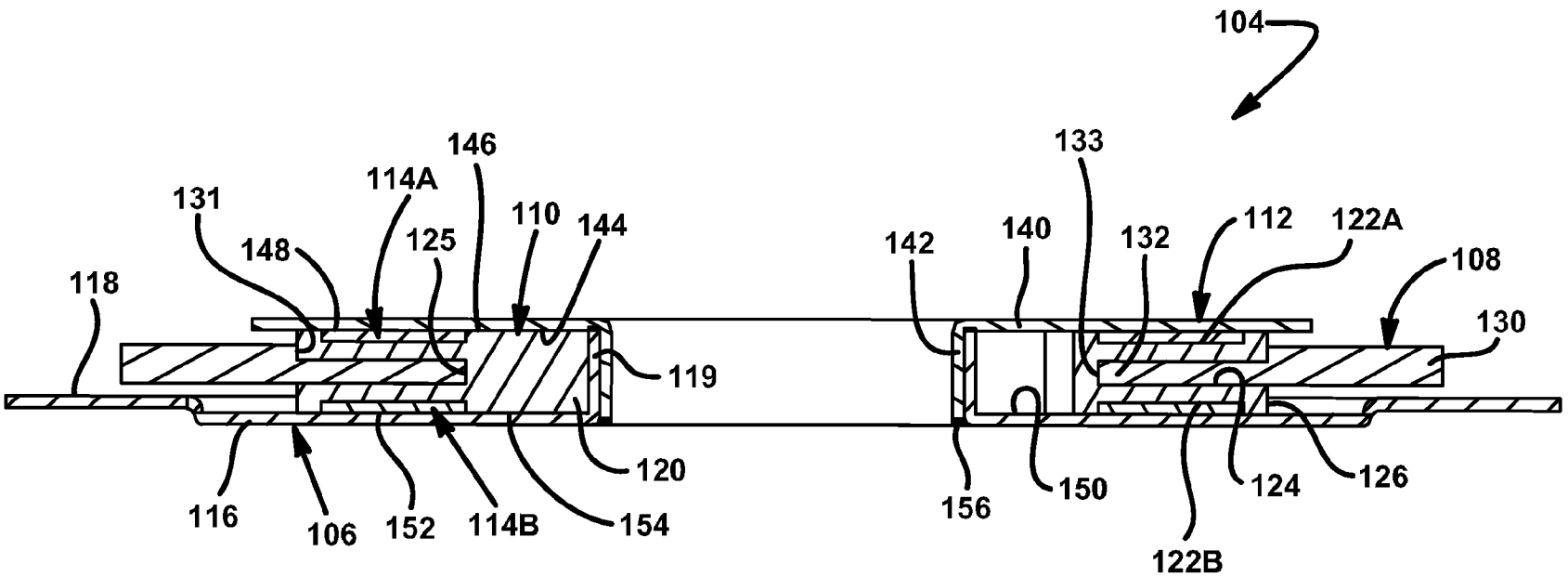
FIG. 8 is a sectional view of the isolation damper assembly taken along line A-A in FIG. 7.

As best seen from FIGS. 6 and 8, mounting ring 108 has a thick outer ring segment 130 and a thin inner ring segment 132. Outer ring segment 130 is adapted for connection with ring 34' of support frame 102. Likewise, inner ring segment 132 is adapted for installation in groove 124 of isolator 110, thereby establishing a slip fit connection between isolator 110 and mounting ring 108. This slip fit acts to inhibit lateral movement of outer tub 20 and support frame 102 relative to base 12' until the force exerted thereon is great enough to cause radial compression of isolator 110. As best seen in FIG. 8, edge surface 133 of inner ring segment 132 abuts, or is in close proximity to, a terminal end surface 125 of groove 124. Likewise, a raised shoulder surface 131 of outer ring segment 130 abuts, or is in close proximity to, end surface 126 of isolator 110. As such, lateral movement of mounting ring 108 relative to isolator 110 will result in a radially directed compressive force being applied to isolator 110 which functions to resist excessive lateral movement of the tub assembly relative to base 12'. Preferably, outer ring 34' of support frame 102 is attached to outer ring segment 130 of mounting ring 108 by conventional fasteners or, in the alternative, via a quick connect type of arrangement. Mounting ring 108 can be fabricated from any material providing the requisite strength and rigidity. Preferably, mounting ring 108 is a stamped or powdered metal component.

As noted, isolation damper assembly 104 also includes an upper case member 112 that is shown to include a planar ring segment 140 and a central tubular hub segment 142. Ring segment 140 has a planar inner face surface 144 adapted to slidingly engage corresponding outer face surfaces 146 and 148 of isolator 110 and upper glide ring 114A, respectively. To this end, upper glide ring 114A is used to control the sliding friction between isolator 110 and upper case member 112. Likewise, lower glide ring 114B permits a controlled amount of sliding friction between isolator 110 and lower case member 106. As seen, an outer face surface 150 of central cup segment 116 in lower case member 106 engages a face surface 152 of glide ring 114B and a face surface 154 of isolator 110. Furthermore, tubular hub segment 142 on upper case member 112 is sized to overlap and engage hub segment 119 on lower case member 106. When assembled, lower case member 106 and upper case member 112 are designed to slightly compress isolator 110 therebetween so as to allow for vibration isolation. In addition, means are provided for securing upper case member 112 to lower case member 106 for maintaining the desired compressive preload on isolator 110. For example, a joint 156 is shown between hub segment 142 of upper case member 112 and hub segment 119 of lower case member 106. This joint is intended to be representative of a rigid coupling which can be established via a suitable fastening mechanism such as, for example, adhesives, welds, crimping, peening, rivets, screws, interlocking tabs, etc.

Isolator 110 performs a number of functions within isolation damper assembly 104. In particular, the compression of isolator 110 between case members 106 and 110 provides for vibration isolation and prevents rotation of support frame 102 relative to base 12'. In addition, the lobed aperture configuration permits lateral movement while also providing a return-to-center function since the compressed lobe will "push back", thereby forcing support frame 102 to return to its centered position. In its assembled state, the terminal ends of lobes 120 are slightly pre-loaded in a radial direction due to engagement with the outer wall surface of hub segment 119 on lower case member 106 so as to establish the normal centered position of the tub assembly along the "Z" axis.

Figure 9:
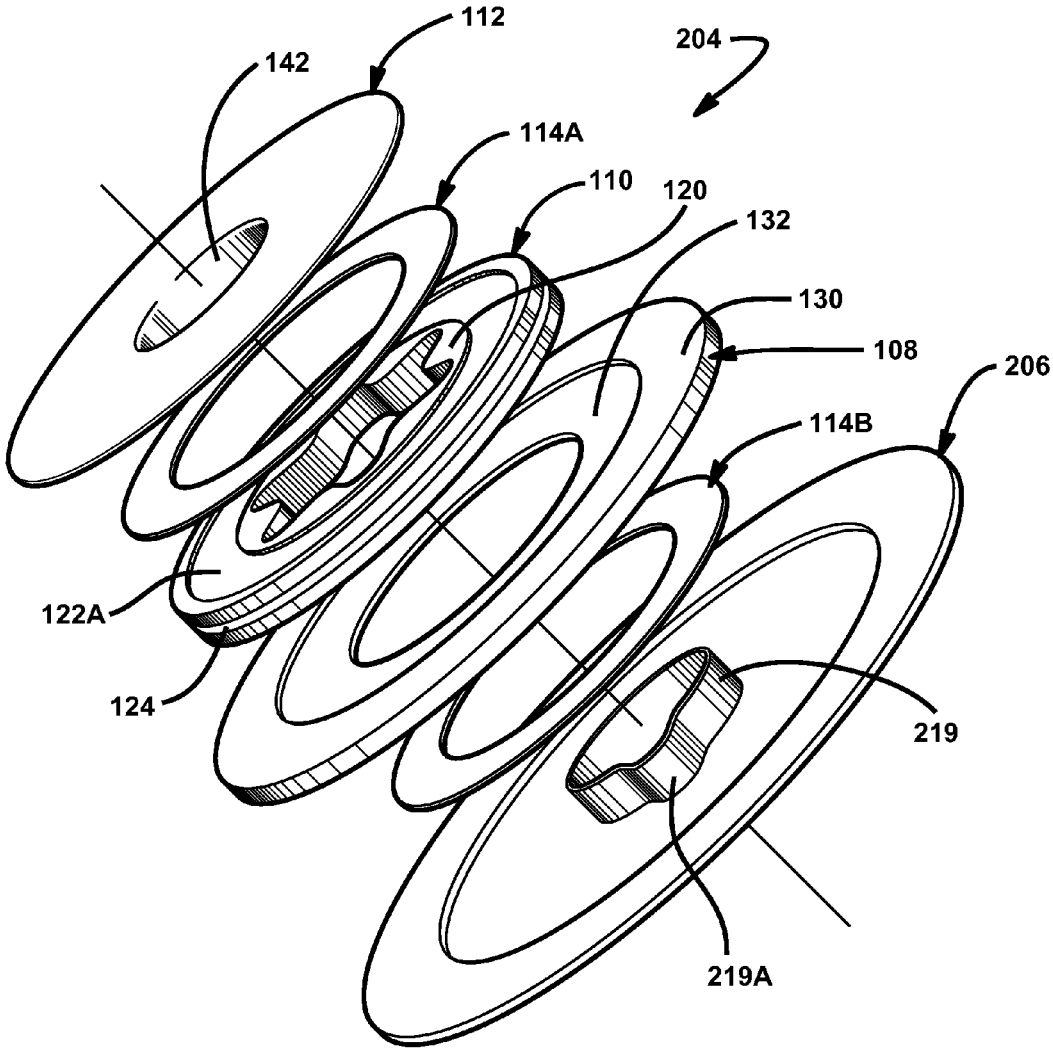
FIG. 9 is an exploded perspective view of an isolation damper assembly constructed in accordance with an alternative preferred embodiment of the present invention.
Figure 10:
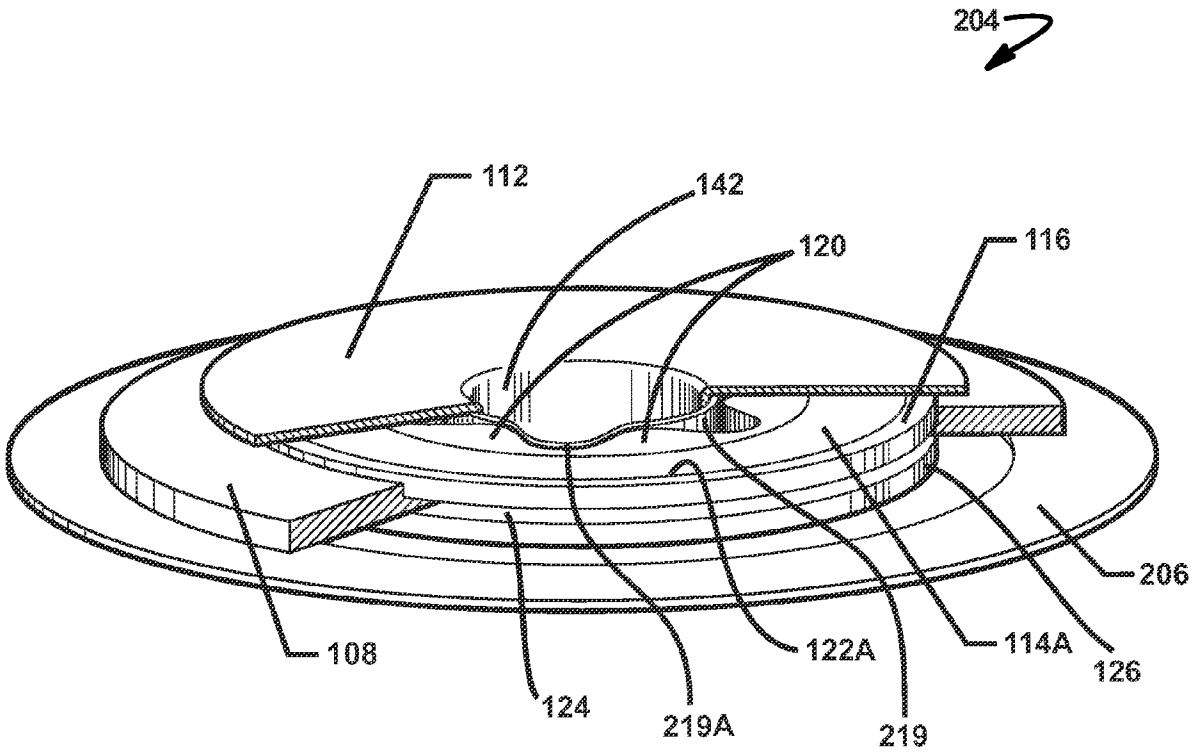
FIG. 10 is an assembled perspective view, with some components partially shown in section, of the isolation damper assembly shown in FIG. 9.

Referring now to FIGS. 9 and 10, a modified version of isolation damper assembly 104, hereinafter referred to by reference numeral 204, is shown to provide an anti-rotation feature between isolator 110 and a lower case member 206. Due to the commonality of most components, the same reference numerals are used to identify those components of isolation damper assembly 204 that are common to those of isolation damper assembly 104. As seen, upstanding hub segment 219 on lower case member 206 is generally cylindrical but is contoured to define a radially outwardly extending lug projection 219A. Upon assembly of the components associated with isolation damper assembly 204, lug projection 219A is disposed between a pair of lobes 120 of resilient isolator 110 so as to prevent relative rotation between isolator 110 and lower case member 206. In addition to this anti-rotation feature, it will be understood that the various features and functions previously described in association with isolation damper assembly 104 are likewise provided by isolation damper assembly 204.

Figure 11:
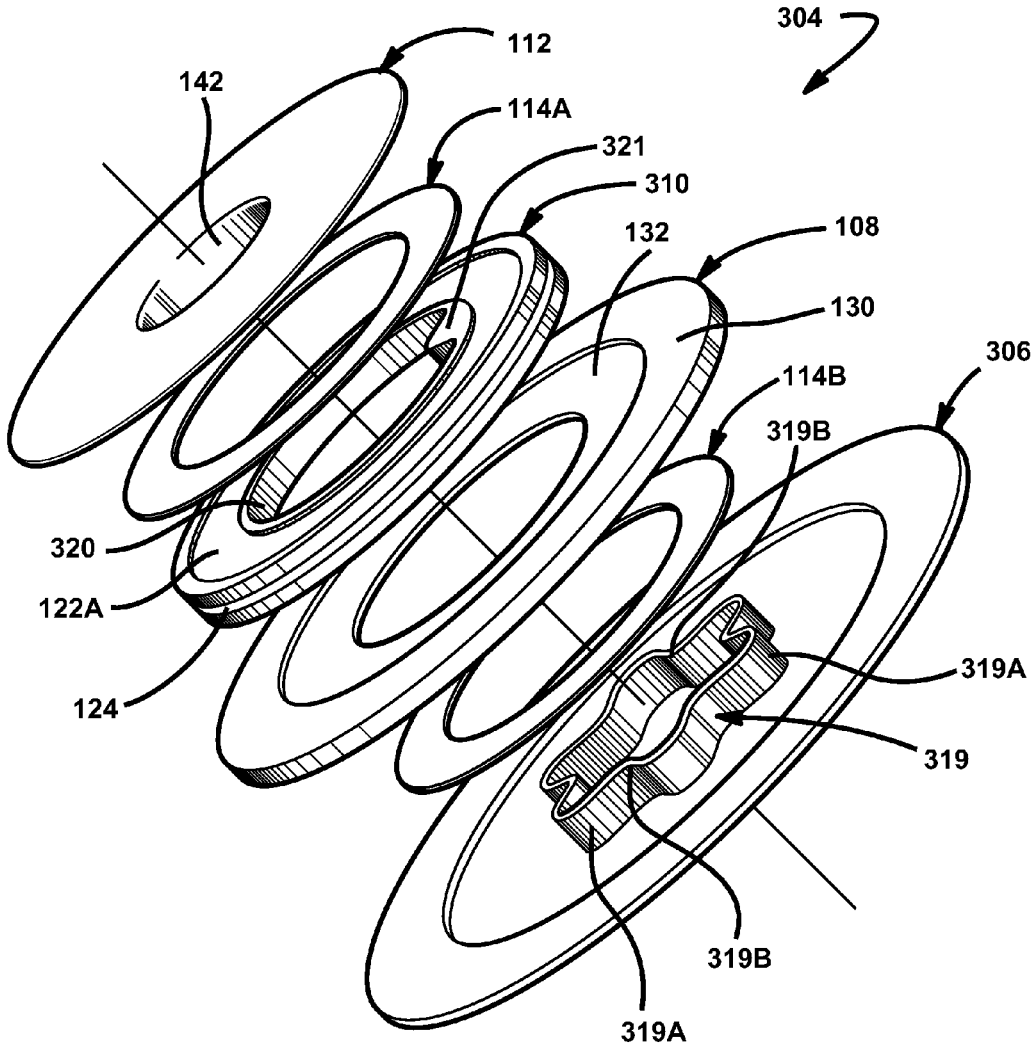
FIG. 11 is an exploded perspective view of an isolation damper assembly constructed in accordance with another alternative preferred embodiment of the present invention.

Referring now to FIG. 11, an alternative embodiment of an isolation damper assembly 304 is shown which also has many components that are common to those previously described in association with isolation damper assembly 104. However, in this arrangement, lower case member 306 has an upstanding hub segment 319 contoured to define a plurality of radially outwardly extending lobe projections 319A while resilient isolator 310 has a generally cylindrical central aperture 320. When isolator damper assembly 304 is fully assembled, the terminal ends of lobe projections 319A will engage the wall surface of aperture 320. Preferably, such engagement results in a slight compressive load being applied to isolator 310 at its localized points of contact with lobe projections 319A. This reversed lobe configuration still functions to permit limited lateral movement of support frame 102 relative to isolator 310 as well as a return-to-center function since the resiliency of the material used for isolator 310 will forcibly bias support frame 102 to return to its centered position along the "Z" axis.

As is also seen from FIG. 11, hub segment 319 of lower case member 306 includes a series of radially inwardly extending lugs 319B which interconnect adjacent pairs of lobes 319A. Upon assembly, the outer wall surface of cylindrical hub segment 142 on upper case member 112 is adapted to engage the terminal ends of lugs 319B so as to provide an interface for rigidly securing upper case member 112 to lower case member 306. Finally, aperture 320 in isolator 310 is shown to include an inwardly extending tang segment 321 that is adapted to be disposed in the channel defined by one of lugs 319B between a pair of lobes 319A, thereby providing an anti-rotation feature between isolator 310 and lower case member 306.

Figure 12:
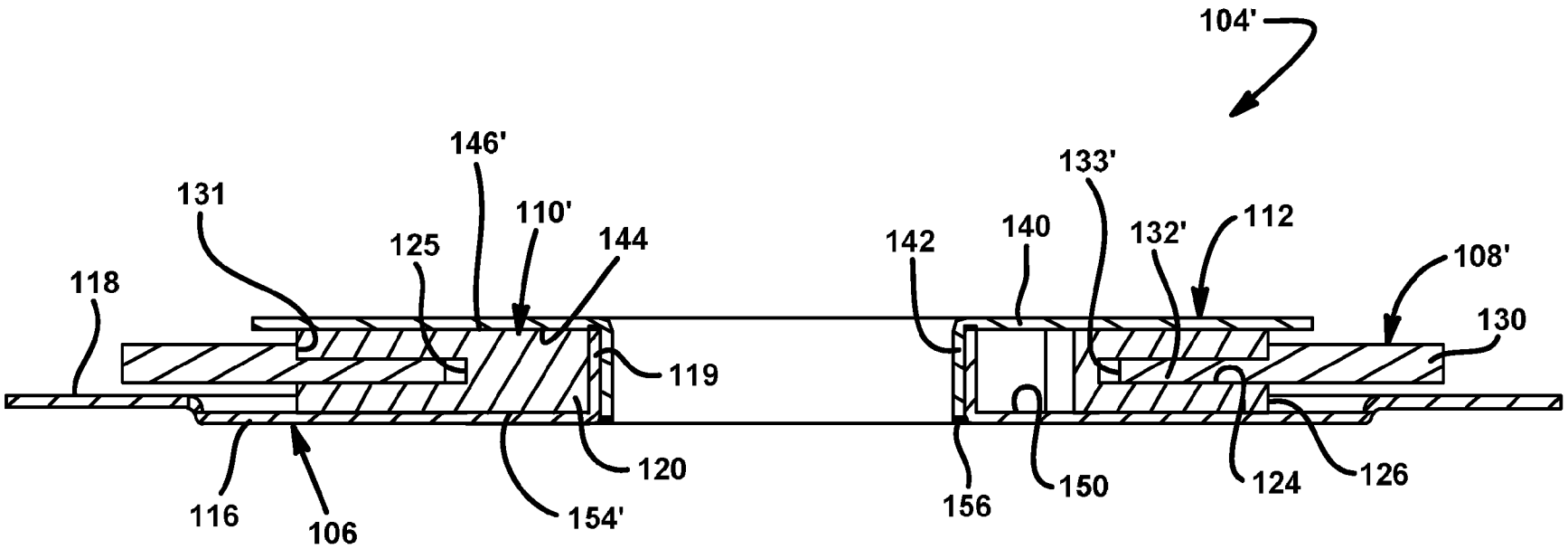
FIGS. 12 and 13 are sectional views, similar to FIG. 8, of isolation damper assemblies according to yet further alternative preferred embodiments of the present invention.

Referring now to FIG. 12, another modified version of isolation damper assembly 104 is illustrated and identified by reference numeral 104'. As seen, glide rings 114A and 114B have been eliminated such that isolator 110' does not include annular upper and lower channels 122A and 122B, respectively. As such, face surfaces 146' and 154' of isolator 110' are now radially extended so as to respectively engage inner face surface 144 of upper case member 112 and outer face surface 150 of lower case member 106. As such, sliding friction between isolator 110' and the interconnected case members can be tuned by the frictional characteristics of the material used for isolator 110' and the magnitude of the radial compressive preload applied to isolator 110' between plate segments 140 and 116 of the assembled case members. In addition, the width of inner ring segment 132' of mounting ring 108' has been reduced such that its terminal edge 133' is displaced from end surface 125 of groove 124. As such, all lateral loading is applied to isolator 110' at its end surface 126 via engagement with radial shoulder surface 131 of mounting ring 108'.

Figure 13:
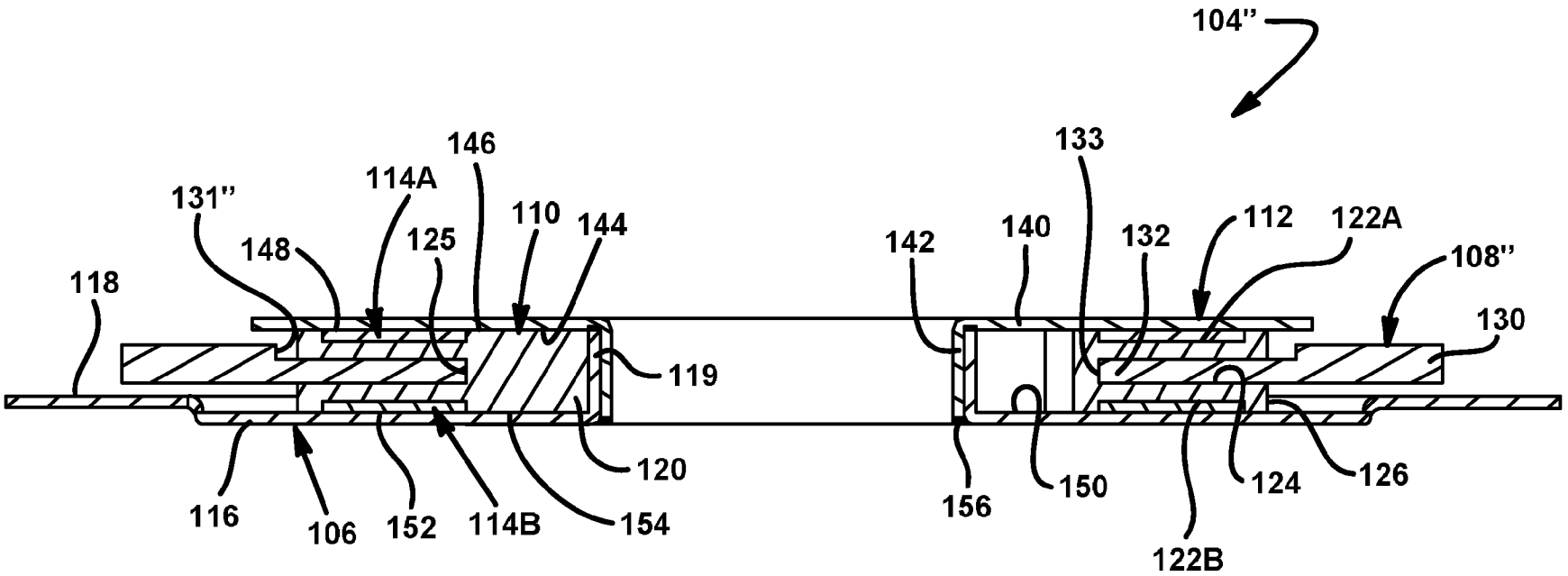

FIG. 13 illustrates another modified version of isolation damper assembly 104 which is identified as isolation damper assembly 104". Basically, isolation damper assembly 104" is arranged to have a mounting ring 108" with its radial should 131" displaced from engagement with end surface 126 of isolator 110 while its inner edge surface 133 is in abutting contact with terminal end 125 of groove 124 in isolator 110. As such, all lateral loading is applied to isolator 110 at its end surface 125 via engagement with edge surface 133 of mounting ring 108".

The isolation damper assemblies of the present invention have been disclosed in an exemplary, non-limiting washing machine application. However, the advantageous features associated with these isolation damper assemblies are well-suited for a plethora of other commercial application. Such commercial applications include, but are not limited to, industrial mixers/shakers, paint shakers, vibrating bowl feeders, vibrating cooling towers, and industrial vibratory and media polishing equipment.

In the drawings and specification, there has been set forth preferred embodiments of the invention and, although specific terms are employed, these are used in a generic and descriptive sense only and not for purpose of limitation. Changes in the form and the proportions of parts, as well as in the substitution of equivalents, are contemplated as circumstances may suggest or render expedient without departing from the spirit or scope of the invention as further defined in the following claims.

What is claimed is:

1. A washing machine comprising:

a cabinet having a base;

a tub;

a support frame connected to said tub; and an isolation damper assembly for resiliently coupling said support frame to said base of said cabinet, said isolation damper assembly having a first member adapted for connection to said cabinet base, a second member adapted for connection to said support frame, and an isolator disposed between said first and second members, said isolator having an aperture within which said first member extends, said aperture having a plurality of projections engaging said first member extending into said aperture.

2. The washing machine of claim 1 wherein said isolator of said isolation damper assembly is made of an elastomeric material.

3. The washing machine of claim 1 wherein said isolator of said isolation damper assembly is made from microcellular polyurethane.

4. The washing machine of claim 1 wherein said first member has a first segment adapted for connection to said cabinet base and a second segment extending transversely to said first segment engaging said plurality of projections in said aperture.

5. The washing machine of claim 4 wherein said plurality of projections engage said second segment of said first member.

6. The washing machine of claim 5 wherein said second segment of said first member is a cylindrical hub segment, wherein said aperture in said isolator includes a plurality of inwardly extending lobes which engage said hub segment, and wherein said isolator is made of a resilient material such that said hub segment exerts a compressive load on said lobes of said isolator.

7. The washing machine of claim 6 wherein said hub segment of said first member includes an outwardly extending lug which is disposed in a channel defined between an adjacent pair of said lobes so as to inhibit rotation of said tub relative to said base.

8. The washing machine of claim 1 wherein said second segment of said first member is a hub segment defining a plurality of outwardly extending lobe projections adapted to engage said aperture in said isolator, and wherein said isolator is made of a resilient material such that said lobe projections exert a compressive load on said isolator.

9. The washing machine of claim 8 wherein said aperture includes an inwardly extending tang which is disposed in a channel defined between an adjacent pair of said lobe projections so as to inhibit rotation of said tub relative to said base.

10. The washing machine of claim 1 wherein said isolation damper assembly further includes a third member coupled to said first member so as to exert a compressive load on said isolator.

11. The washing machine of claim 10 wherein said isolator has a groove receiving a rim portion of said second member therein.

12. A washing machine comprising:

a cabinet;

a tub assembly located within said cabinet and including an outer tub and a spin basket supported for rotation within said outer tub;

a support frame mounted to said outer tub;

a drive assembly operable for driving said spin basket; and a resilient isolator coupled to one of said support frame and said cabinet, said resilient isolator having a central aperture, said central aperture having a plurality of projections engaging the other one of said support frame and said cabinet, thereby coupling said support frame to said cabinet, said resilient isolator operable to inhibit rotation of said outer tub relative to said cabinet and bias said outer tub to a centered position within said cabinet.

13. The washing machine of claim 12 further comprising:

a lower case member mounted to a base segment of said cabinet;

an upper case member spaced from and connected to said lower case member; and a mounting ring secured to said support frame and engaging said isolator, and wherein said isolator is disposed between said lower and upper case members.

14. The washing machine of claim 13 wherein at least one of said upper and lower case members has a tubular segment extending into and engaging said plurality of projections in said central aperture of said isolator.

15. The washing machine of claim 14 wherein said plurality of projections in said central aperture in said isolator engages said tubular segment.

16. The washing machine of claim 15 wherein said tubular segment includes a lug which is disposed in a space defined between an adjacent pair of said projections in said central aperture of said isolator.

17. The washing machine of claim 14 wherein said tubular segment defines a plurality of outwardly extending projections engaging said central aperture of said isolator, and wherein said central aperture in said isolator includes an inwardly extending tang which is disposed in a space defined to be an adjacent pair of said projections on said tubular segment.

18. The washing machine of claim 14 wherein said isolator includes a groove formed in its edge surface, and wherein said mounting ring includes a rim segment disposed in said groove.

19. The washing machine of claim 12 wherein said isolator is fabricated from an elastomeric material.

20. The washing machine of claim 19 wherein said isolator is fabricated from a microcellular polyurethane material.

21. A washing machine comprising:

a cabinet;

a tub assembly located within said cabinet and including an outer tub, a spin basket supported for rotation within said outer tub, and an agitator supported for rotation within said spin basket;

a support frame mounted to said outer tub;

a drive assembly operable for driving said spin basket and oscillating said agitator;

a hub having a plurality of outwardly extending lobe projections; and a resilient isolator having a central aperture adapted to engage said lobe projections of said hub, wherein said hub is coupled to one of said cabinet and said support frame and said resilient isolator is coupled to the other one of said cabinet and said support frame, thereby resiliently coupling said support frame to said cabinet such that said resilient isolator is operable to inhibit rotation of said outer tub relative to said cabinet and bias said outer tub to a centered position within said cabinet.

* * * * *